United States Patent [19]

Lipkin

[11] Patent Number: 4,662,007

[45] Date of Patent: May 5, 1987

[54] ELASTIC HINGELESS CAP

[75] Inventor: William S. Lipkin, Minneapolis, Minn.

[73] Assignee: M. U. Industries, Inc., Minneapolis, Minn.

[21] Appl. No.: 835,206

[22] Filed: Mar. 3, 1986

[51] Int. Cl.[4] ..... H42B 1/02

[52] U.S. Cl. ..... 2/195; 2/200; 2/196

[58] Field of Search ..... 2/195, 200, 197, 209, 2/209.4, 196

[56] References Cited

U.S. PATENT DOCUMENTS

| | | | |
|---|---|---|---|
| 1,816,346 | 5/1929 | Silverstein | 2/195 |
| 2,697,835 | 12/1954 | Stone | 2/185 B |
| 2,869,134 | 1/1959 | Milstein | 2/197 |
| 2,883,669 | 4/1959 | Rafowitz | 2/195 |
| 2,885,683 | 5/1959 | Lipkin | 2/197 |
| 3,077,607 | 2/1963 | Bregenzer | 2/195 |
| 3,134,983 | 6/1964 | Lipkin | 2/195 |
| 3,247,523 | 4/1966 | Lipkin | 2/197 |
| 4,486,903 | 12/1984 | Krystal | 2/197 |
| 4,549,316 | 10/1985 | Johnson | 2/195 |

*Primary Examiner*—Werner H. Schroeder
*Assistant Examiner*—Mary A. Ellis
*Attorney, Agent, or Firm*—Orrin M. Haugen; Thomas J. Nikolai; Frederick W. Niebuhr

[57] ABSTRACT

A cap structure suitable for multi-size utilization including a shell forming the crown portion with the gores forming the lateral and rear portions being fabricated from generally uniaxially stretchable fabric. The visor portion is secured to the non-stretch gores disposed along the forward edge of the shell, and an elongated band forming an ear flap portion is secured to the base of the shell. The forwardly disposed gores are preferably backed with a foam layer to provide a degree of rigidity to the structure. The ear flap portion is adapted to be folded inwardly and upwardly in a first disposition, and downwardly about the ears of the wearer in an ear-enveloping disposition, with the ear flap portion being fabricated from a material which is stretchable along the axial length thereof. A stitching seam is provided to secure the ear flap portion to the crown portion, and with the positioning of the stitches coupling the crown portion to the ear flap portion.

2 Claims, 5 Drawing Figures

ELASTIC HINGELESS CAP

BACKGROUND OF THE INVENTION

The present invention relates generally to an improved cap structure, and more particularly to an improved multi-size cap having a typical baseball cap configuration, and with one size being adapted to accommodate wearers with a variety of sizes of heads. The multi-size cap structure of the present invention is further provided with ear flaps which fold inwardly and upwardly of the crown portion of the cap when not in use, and with the cap having a number of axially stretchable gores to enhance the comfort of the cap and avoid a tight-fitting structure. This confort is achieved with the ear flaps folded up, and further avoids a loose-fitting cap when the ear flaps are folded downwardly to envelope the ears of the wearer in cold weather and the area or diameter of the cap interior loses its inner folded layer. The structure of the present invention permits multi-size cap structures to be fabricated which are comfortable for the wearer, and with a single size of cap being adaptable for use by all persons with heads within a number of normal sizes.

In the past, attempts have been made to provide multi-size cap structures of the baseball cap style, and such caps are in wide-spread use today. Typically, multi-size caps are created through the utilization of a variable-length snap arrangement which permits the user to adjust the cap size as required. Such caps, normally, do not include ear flaps. More recently, attempts have been made to provide caps of the baseball cap type or style, wherein ear flaps are provided to provide an added degree of comfort to the wearer during unseasonable weather, including cold weather with precipitation in the form ofeither rain or snow. Such caps are frequently of the single or fixed size variety.

Multi-size caps of the baseball cap style are marketed in a variety of ways. These caps are marketed through conventional retail outlets, and have also found a substantial market as promotional items. In the marketing of outer wear products, it is, of course, more economical to provide such products with a minimal number of sizes. Thus, economy of numbers may be achieved through utilization of caps of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the multi-size caps become extremely desirable for the customer.

As is conventional, baseball caps employ a crown portion to which a visor is secured to the forward edge of the crown and extends outwardly therefrom. An elongated band of axially stretchable material forming an ear flap portion is hingedly secured to the base of the crown and is adapted to be upwardly and inwardly folded in one disposition, and is also adapted to be downwardly folded about the ears of the wearer in its ear-enveloping disposition during cold weather. A stitching seam secures the elongated ear flap portion to the crown portion along both the the lateral as well as the rear segments of the crown portion.

In utilization of caps for outer wear, it is desirable for the forward portion to be somewhat rigid so that, for appearance purposes, the crown portion stands somewhat erect. Also, such an arrangement will normally provide a means for the visor portion to be rigid, durable, and extend generally forwardly of the wearer's forehead. Accordingly, the front gores or panels may be fitted and/or stiffened with a foam layer in order to stand generally erect during wear.

Gores forming the rear portion of the crown are uniaxially stretchable, a woven cloth normally being employed. Such cloth structures typically have a synthetic resin foam fiber forming the fabric layers. The weave of the fabric layers is such that the cloth is uniaxially stretchable in the peripheral direction of the cap structure. In other words, the uniaxial stretch occurs in the direction of the edge-band of the cap. Such a material is utilized in selected gores only of the multi-size cap structures of the present invention, and thereby assist in achieving an accommodation of wearers with leads of various sizes together with the fitted front portion. The combination of the rear crown portion fabricated with uniaxially stretchable fabric, and with the front gore portions being formed of non-stretchable, somewhat rigid fabric provides a desirable combination of properties for the cap. These desirable properties include warmth and comfort for the wearer, as well as an attractive design which is capable of stretching for fitting a variety of sizes.

For purposes of achieving substantially universal utilization with a single size cap structure, the material forming the gores for the rear crown portion is selected so that it is capable of a 20 percent stretch along one axial direction. Such materials are, of course, commercially available. For those instances when more than one size cap structure will be employed to accommodate all wearers, a uniaxial stretch of up to about 10 percent is normally found to be satisfactory.

As indicated, the forward portion of the cap will normally be provided with a visor or bill, with the visor normally being positioned above the eyes and forehead of the wearer. The visor material is non-stretchable or non-elastic. Even considering the requirements of the presence of the visor or bill, along with the adjacent gores being fabricated of non-stretch fabric, together with the constraint on the number of sizes to be stocked so as to accommodate wearers with heads of normal sizes, the cap structure of the present invention has been found to accommodate these desirable features and provide a means for manufacturing a cap for unseasonable or winter weather wherein a single cap structure capable of multi-size accommodation may be employed.

The structure of the present invention permits a cap to be designed which is attractive in use, comfortable for the wearer, and further provides the advantageous feature of multiple size capability. Such cap designs are utilized by individuals for a variety of outdoor purposes, including work purposes as well as sport purposes, including such sports as hunting, fishing, and the like.

SUMMARY OF THE INVENTION

Therefore, it is a primary object of the present invention to provide an improved baseball-type cap for fitting multiple sizes and employing ear flaps for winter-time use, and wherein a portion of the structure is fabricated from uniaxial stretchable fabric, including stretchable laminated foam fabrics.

It is a further object of the present invention to provide a baseball-type cap structure capable of multi-size use, which can be manufactured utilizing conventional materials and fabrics, and which is both functional and attractive in its use and appearance.

It is yet a further object of the present invention to provide an improved multi-size cap structure of the baseball-cap style, which employs inwardly folding ear flaps fabricated of uniaxially stretchable material to accommodate winter-time use, and wherein the forward portion of the cap structure is designed with non-stretch fabric.

Other and further objects of the present invention will become apparent to those skilled in the art upon a study of the following specification, appended claims and accompanying drawing.

IN THE DRAWINGS

DESCRIPTION OF THE PREFERRED EMBODIMENT

Figure 1:
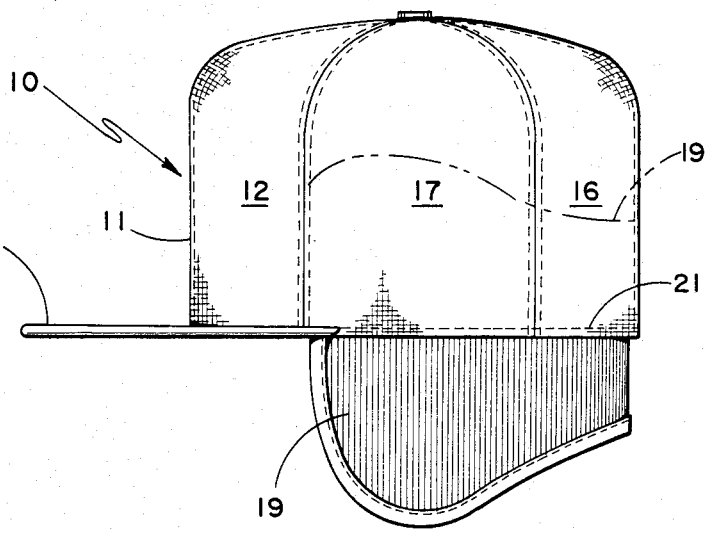
FIG. 1 is a side elevational view of a baseball-type cap made in accordance with the present invention, and illustrating the ear flap portion in lowered disposition.
Figure 2:
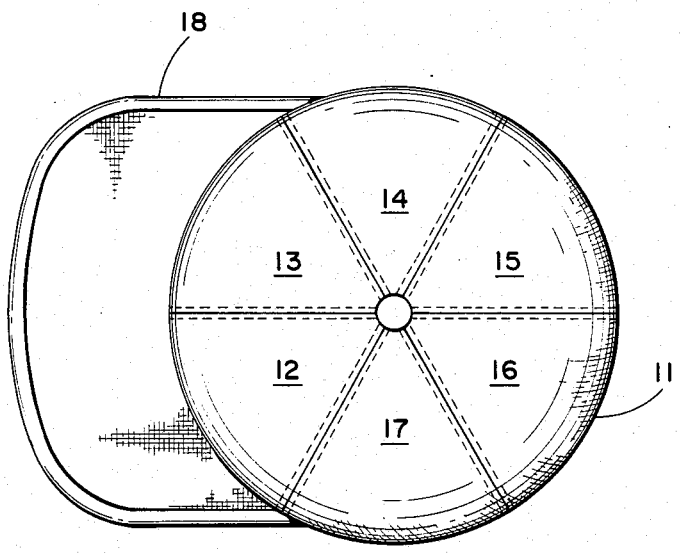
FIG. 2 is a top plan view of the cap shown in FIG. 1.

In accordance with the preferred embodiment of the present invention, and with particular attention directed to FIGS. 1 and 2, and multi-size cap structure generally designated 10 includes a multi-gore shell 11 formed of individual gores such as gores 12, 13, 14, 15, 16 and 17 forming the crown portion. A visor or bill portion 18 is secured to the forward edge of the shell and extends outwardly therefrom. The visor, as previously indicated, is normally somewhat rigid, and hence is not stretchable in the manner in which the crown portion is stretchable. An elongated band forming an ear flap portion 19 is hingedly secured to the base of the shell as at 17, about the lateral and rear gore portions 14,15,16 and 17 respectively of the shell 11. A stitch seam hinge as at 21 functions as the inter-coupling member. The ear flap portion is adapted to be folded inwardly and upwardly of the shell to assume an inwardly folded first disposition. Alternatively, the end flap portion may be folded downwardly about the ears of the wearer in an ear-enveloping disposition. The hinge means securing the ear flap portion to the crown portion is, of course, sufficiently flexible so as to accommodate the folding of the flaps.

As previously indicated, gores 12 and 13 are fabricated of either fitted or stiffened material. For example, a foam member may be placed in combination with the woven material, in order to provide additional stiffening to these gore members. Normally, for appearance purposes, gores 12 and 13 are faced with a durable fabric to provide for long-wearing characteristics. Also, as other alternatives, non-woven interfacing stabilizing material may be employed in combination with gores 12 and 13, such as paper or cardboard or spun cloth.

The rigidity of gores 12 and 13 provide for a crown which stands generally erect, and enhances the appearance of the cap, particularly adjacent and above the visor. The combination of the generally stiffenend gores 12 and 13 with stretchable gores 14–17 inclusive enhances the ability of the cap to fit a variety of head sizes.

The stretchability feature is present in gores 14–17, and as has been indicated, the gores 14–17 stretch in the peripheral direction only. The stretchable feature permits a cap manufacturer to fit all normal head sizes with two separate and distinct models.

Figure 3:
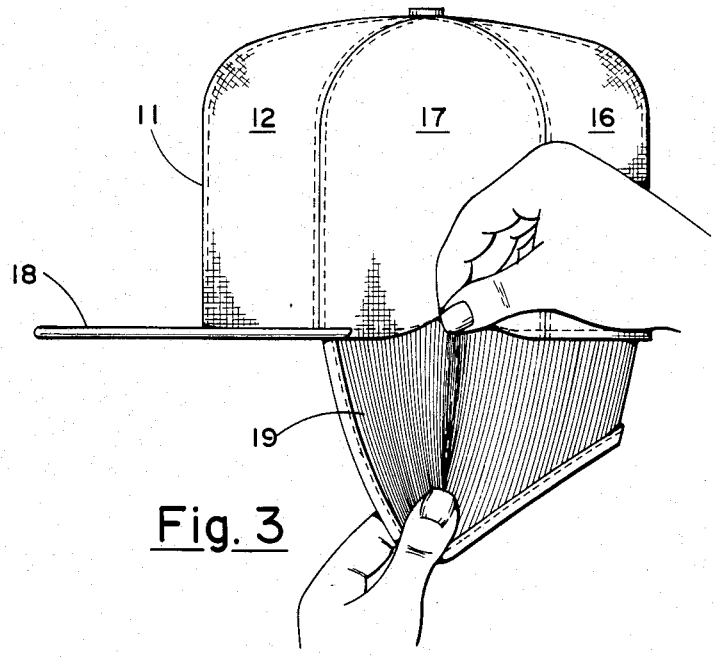
FIG. 3 is a view similar to FIG. 1, but illustrating the manner in which the ear flap portions may be withdrawn from the interior of the cap.

As indicated, the cap contains ear flaps as at 19, which are hingedly secured to the cap body along a stitch zone 21. A conventional chain stitch is normally used, with elastic thread. The ear flaps are preferably stretchable along one axis, such as is indicated in FIGS. 3 and 5.

Figure 5:
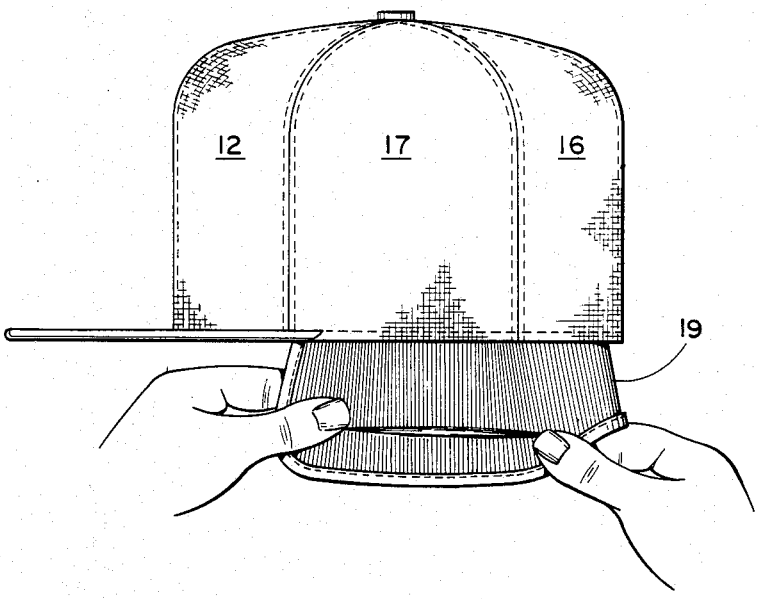
FIG. 5 is a view similar to FIG. 3, and illustrating the manner in which the ear flap portion may be stretched along the axis of the base of the cap.

As indicated in FIG. 5, ear flap portion 19 is stretchable, and, as conventional, may be folded inwardly and upwardly for wear during those periods when ear flaps are not required. The disposition of the flaps, when inverted and not in use is illustrated in FIG. 1 in phantom.

Figure 4:
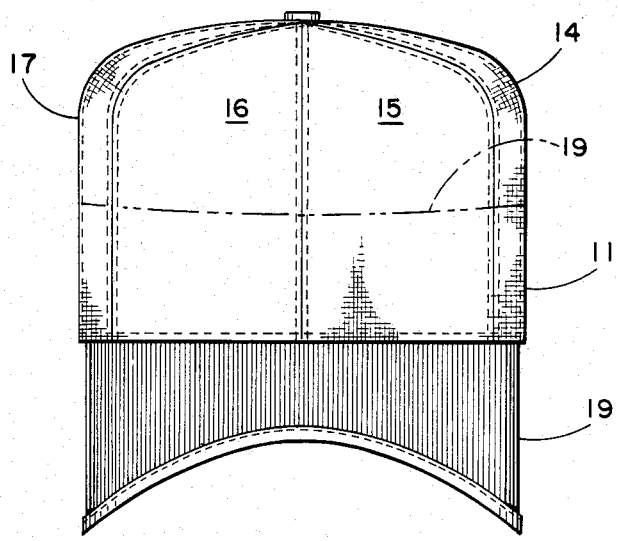
FIG. 4 is a rear elevational view of the cap.

FIGS. 4 and 5 illustrate the disposition of the cap and the configuration of the ear flaps when in lowered disposition. As shown in FIG. 5, the flap portions are stretchable in the peripheral direction, and for ease of manufacture and utilization, may be stretchable along the other axis well.

As indicated, the structure of the present invention provides the advantage of a cap of aesthetically pleasing design, together with the ability to manufacture the cap with only two sizes to fit all normal head sizes. Also, the wearer may utilize the inwardly folded ear flaps whenever cold weather conditions make it desirable for ear flaps to be employed.

It will be appreciated that various modifications of the present invention may be undertaken by those skilled in the art without departing from the spirit and scope hereof.

I claim:

1. In a multi-size cap structure adapted to accommodate wearers of various sizes of heads and including a multi-gore shell forming the crown portion, a visor portion secured to the forward edge of said shell and extending outwardly therefrom, an elongated band forming an ear flap portion hingedly secured to the base of said shell about the lateral and rear portions thereof, and adapted to be folded inwardly and upwardly in an inwardly folded first disposition, and downwardly about the ears of the wearer in an ear-enveloping disposition, and means hingedly securing said elongated band to said crown portion along the length thereof, the improvement comprising:

(a) said multi-gore shell forming the crown portion including a pair of front gores fixedly secured to said visor, and a plurality of lateral and rearwardly positioned gores, each of said gores extending from a common apex point;

(b) said front gores being fabricated of nonstretch material and being sufficiently rigid so as to be generally self-supporting;

(c) said lateral and rearwardly disposed gores being fabricated from a uniaxially stretchable material, capable of being stretched along the chordal axis of said cap; and (d) said ear flap portions being fabricated essentially entirely from a cloth material which is stretchable along at least one axis, and wherein said at least one stretchable axis extends generally parallel with the chordal axis of the body of the cap to which the flap portion is secured.

2. The structure as defined in claim 1 being particularly characterized in that said forward gores are fabricated from a laminate of synthetic resinous foam having a layer of fabric bonded to the inner surface thereof.

* * * * *